US009774127B2

(12) United States Patent
Yamaki et al.

(10) Patent No.: US 9,774,127 B2
(45) Date of Patent: Sep. 26, 2017

(54) CONNECTOR INCLUDING ELECTRIC WIRE COVER WITH CATCHING PORTION

(71) Applicant: YAZAKI CORPORATION, Tokyo (JP)

(72) Inventors: Shin Yamaki, Shizuoka (JP); Hisaya Shibata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/164,638

(22) Filed: May 25, 2016

(65) Prior Publication Data

US 2016/0352039 A1 Dec. 1, 2016

(30) Foreign Application Priority Data

May 27, 2015 (JP) ..... 2015-107803

(51) Int. Cl.
*H01R 9/22* (2006.01)
*H01R 13/506* (2006.01)
(Continued)

(52) U.S. Cl.
CPC ..... *H01R 13/506* (2013.01); *H01R 13/56* (2013.01); *H01R 13/62938* (2013.01)

(58) Field of Classification Search
CPC ..... H01R 9/223; H01R 9/2416; H01R 31/02; H01R 13/62938; H01R 13/62955;
(Continued)

(56) References Cited

U.S. PATENT DOCUMENTS 5,286,225 A * 2/1994 Tsuji ..... H01R 13/514 439/717
5,556,301 A * 9/1996 Chishima ..... H01R 31/08 439/101
(Continued)

FOREIGN PATENT DOCUMENTS

JP 7-298450 A 11/1995
JP 2003-272755 A 9/2003
(Continued)

OTHER PUBLICATIONS

Japanese Office Action for the related Japanese Patent Application No. 2015-107803 dated Apr. 18, 2017.

*Primary Examiner* — Abdullah Riyami
*Assistant Examiner* — Vladimir Imas
(74) *Attorney, Agent, or Firm* — Kenealy Vaidya LLP

(57) ABSTRACT

A connector includes a housing and an electric wire cover assembled with the housing. The housing includes a terminal housing portion and an electric wire leading portion. A locking rib protruding outward is formed on the electric wire leading portion. An assembling portion is formed on an end part of the electric wire cover facing to the housing. The assembling portion includes a locking protrusion and a catching portion protruding more than the locking protrusion in a mounting direction of mounting the electric wire cover on the housing. The catching portion includes a sliding face inclined with respect to the mounting direction. When the electric wire cover is mounted on the housing, the sliding face makes contact with the electric wire leading portion, thereby the assembling portion is displaced outward.

5 Claims, 6 Drawing Sheets

(51) Int. Cl.
*H01R 13/56* (2006.01)
*H01R 13/629* (2006.01)

(58) Field of Classification Search
CPC ..... H01R 13/62933; H01R 13/62905; H01R 23/7005; H02G 3/14; H04Q 1/142
USPC ..... 439/718, 157
See application file for complete search history.

(56) References Cited

U.S. PATENT DOCUMENTS 5,681,175 A * 10/1997 Busse ..... H01R 13/62977 439/157
5,888,081 A * 3/1999 Konoya ..... H01R 13/62955 439/157
5,944,561 A * 8/1999 McCleerey ..... H01R 13/447 220/844
5,947,762 A * 9/1999 Katsuma ..... H01R 13/5202 439/157
6,168,445 B1 * 1/2001 Seutschniker ... H01R 13/62933 439/157
6,176,746 B1 * 1/2001 Morello ..... B60R 16/0239 16/232
6,193,531 B1 * 2/2001 Ito ..... H01R 13/62933 439/140
6,354,852 B2 * 3/2002 Noro ..... H01R 13/62938 439/157
6,755,674 B2 * 6/2004 Fujii ..... H01R 13/506 439/157
6,817,888 B2 * 11/2004 Kozono ..... H01R 13/62933 439/468
6,824,406 B1 * 11/2004 Sharples ..... H01R 13/62977 439/157
6,848,925 B2 * 2/2005 Nishide ..... H01R 13/73 439/157
6,848,946 B2 * 2/2005 Vicenza ..... B60R 16/0238 439/620.29
7,121,901 B1 * 10/2006 Chen ..... H01R 9/223 439/718
7,134,921 B2 * 11/2006 Siracki ..... H01R 4/305 439/718
7,150,640 B2 * 12/2006 Fukui ..... H01R 13/62955 439/157
7,234,952 B2 * 6/2007 Sasaki ..... H01R 13/6295 439/157
7,303,415 B2 * 12/2007 Tyler ..... H01R 13/4365 439/157
7,553,180 B2 * 6/2009 Hu ..... E05C 19/06 220/284
7,922,503 B1 * 4/2011 Kobayashi ..... H01R 13/6295 439/157
7,939,754 B2 * 5/2011 Richter ..... H01R 13/6641 136/244
8,003,885 B2 * 8/2011 Richter ..... H01R 4/28 136/244
8,251,761 B2 * 8/2012 Shamoto ..... H01R 13/506 439/892
8,684,756 B2 * 4/2014 Kobayashi ..... H01R 13/6295 439/157
8,882,521 B2 * 11/2014 Conway ..... H01R 13/5213 439/157
8,979,560 B2 * 3/2015 Kobayashi ..... H01R 13/62955 439/157
9,033,729 B2 * 5/2015 Klein ..... H01R 13/62 439/549
2003/0181083 A1 * 9/2003 Kozono ..... H01R 13/447 439/152
2006/0228921 A1 * 10/2006 Fukui ..... H01R 13/62955 439/157
2007/0087599 A1 * 4/2007 Sasaki ..... H01R 13/6295 439/157
2008/0102668 A1 * 5/2008 Ikeya ..... H01R 13/62938 439/157
2013/0102168 A1 * 4/2013 Kobayashi ..... H01R 13/5213 439/141

FOREIGN PATENT DOCUMENTS

JP 2006-294358 A 10/2006
JP 2008-305726 A 12/2008
JP 2011-90881 A 5/2011
WO 2011/049242 A1 4/2011

* cited by examiner

CONNECTOR INCLUDING ELECTRIC WIRE COVER WITH CATCHING PORTION

CROSS REFERENCE TO RELATED APPLICATIONS

This application is based on Japanese Patent Application (No. 2015-107803) filed on May 27, 2015, the contents of which are incorporated herein by reference.

BACKGROUND OF THE INVENTION

1. Field of the Invention

The present disclosure relates to a connector equipped with an electric wire cover.

2. Description of the Related Art

A connector is known in which an electric wire cover made of resin is mounted to an electric wire leading portion formed at a rear part of a connector housing, bundle of electric wires led out from the electric wire leading portion are protected by this electric wire cover, and the bundle of electric wires is guided in a predetermined direction by the electric wire cover (for example, refer to JP-A-2011-90881).

An electric wire cover made of resin may be distorted sometimes during molding. If such distortion occurs in the electric wire cover, the dimensional accuracy of the portion of the electric wire cover to be assembled with a connector housing becomes lower, and there is a risk that the workability of assembling the electric wire cover with the connector housing may become low.

SUMMARY OF THE INVENTION

The present disclosure is made in consideration of the above-mentioned circumstances, and an object of the present disclosure is to provide a connector in which its electric wire cover can be smoothly assembled with its connector housing.

The above-mentioned object of the present disclosure will be achieved by using the configurations described below.

(1) A connector including:

a housing including:

a terminal housing portion configured to receive a terminal connected to an electric wire; and an electric wire leading portion from which the electric wire is led out; and an electric wire cover configured to be assembled with the electric wire leading portion so as to cover the electric wire, wherein a locking rib protruding outward is formed on a circumference portion of the electric wire leading portion;

wherein an assembling portion configured to surround the circumference portion of the electric wire leading portion is formed on an end part of the electric wire cover facing to the housing;

wherein the assembling portion includes:

a locking protrusion protruding inward to be locked with the locking rib; and a catching portion protruding more than the locking protrusion in a mounting direction of mounting the electric wire cover on the housing;

wherein the catching portion includes a sliding face gradually inclined outward with respect to the mounting direction; and wherein when the electric wire cover is mounted on the housing, the sliding face of the catching portion makes contact with the electric wire leading portion, thereby the assembling portion is displaced outward.

(2) The connector configured as described in the above-mentioned item (1), wherein an electric wire guiding portion is formed in the electric wire cover and is configured to derive the electric wire, the electric wire guiding portion having the end part of the electric wire cover; and wherein the catching portion is provided at an end portion of the electric wire cover on the side of the electric wire guiding portion.

(3) The connector configured as described in the above-mentioned item (2), wherein the electric wire cover is brought close to the housing in a state of being displaced to a opposite side of the electric wire guiding portion with respect to the housing, and the locking protrusion being disposed more on a front side than the locking rib in the mounting direction is slid toward the electric wire guiding portion with respect to the housing, thereby the locking protrusion is disposed at a position where the locking protrusion is locked with the locking rib.

(4) The connector configured as described in the above-mentioned item (1), wherein the catching portion is provided at an end of the assembling portion in a width direction of the electric wire cover being substantially perpendicular to the mounting direction.

(5) The connector configured as described in the above-mentioned item (1), wherein a protruding amount of the catching portion protruding from the assembling portion in the mounting direction is greater than that of the locking protrusion protruding from the assembling portion in the mounting direction.

With the connector having the configuration described in the above-mentioned item (1), when the electric wire cover is assembled with the housing, the sliding face of the catching portion protruding more than the locking protrusion in the direction of mounting the electric wire cover on the connector housing makes contact with the electric wire leading portion of the housing, whereby the assembling portion is displaced outward. Hence, even if the electric wire cover is distorted, the difficulty of the assembling due to the bumping of the locking protrusion against the housing is prevented, whereby the electric wire cover can be smoothly mounted on the housing. Consequently, the assembling workability of the electric wire cover can be improved.

With the connector having the configuration described in the above-mentioned item (2), since the catching portions are provided at the end portion on the side of the electric wire guiding portion that is liable to be affected by the distortion particularly during molding of the electric wire cover, the distortion of the electric wire cover can be corrected effectively by the catching portion when the electric wire cover is mounted on the connector housing.

With the connector having the configuration described in the above-mentioned item (3), since the distortion of the electric wire cover is corrected by the catching portion, the biting of the electric wires can be suppressed when the electric wire cover is slid and the locking protrusions are locked with the locking ribs. Hence, it is possible to reduce the worker's burden of paying attention to the biting of the electric wires at the time of the assembling of the electric wire cover.

The present disclosure can provide a connector in which its electric wire cover can be smoothly assembled with its connector housing.

The present disclosure has been described above briefly. The details of the present disclosure will be further clarified by reading the descriptions of the mode (hereafter referred to as "embodiment") for embodying the invention to be described below referring to the accompanying drawings.

BRIEF DESCRIPTION OF THE DRAWINGS

FIG. 3A is a front view showing the electric wire cover as seen from the side of the electric wire guiding portion of the electric wire cover, and FIG. 3B is a sectional view taken on line A-A in FIG. 3A.

DETAILED DESCRIPTION OF THE EXEMPLARY EMBODIMENTS

An embodiment according to the present disclosure will be described below referring to the accompanying drawings.

Figure 1:
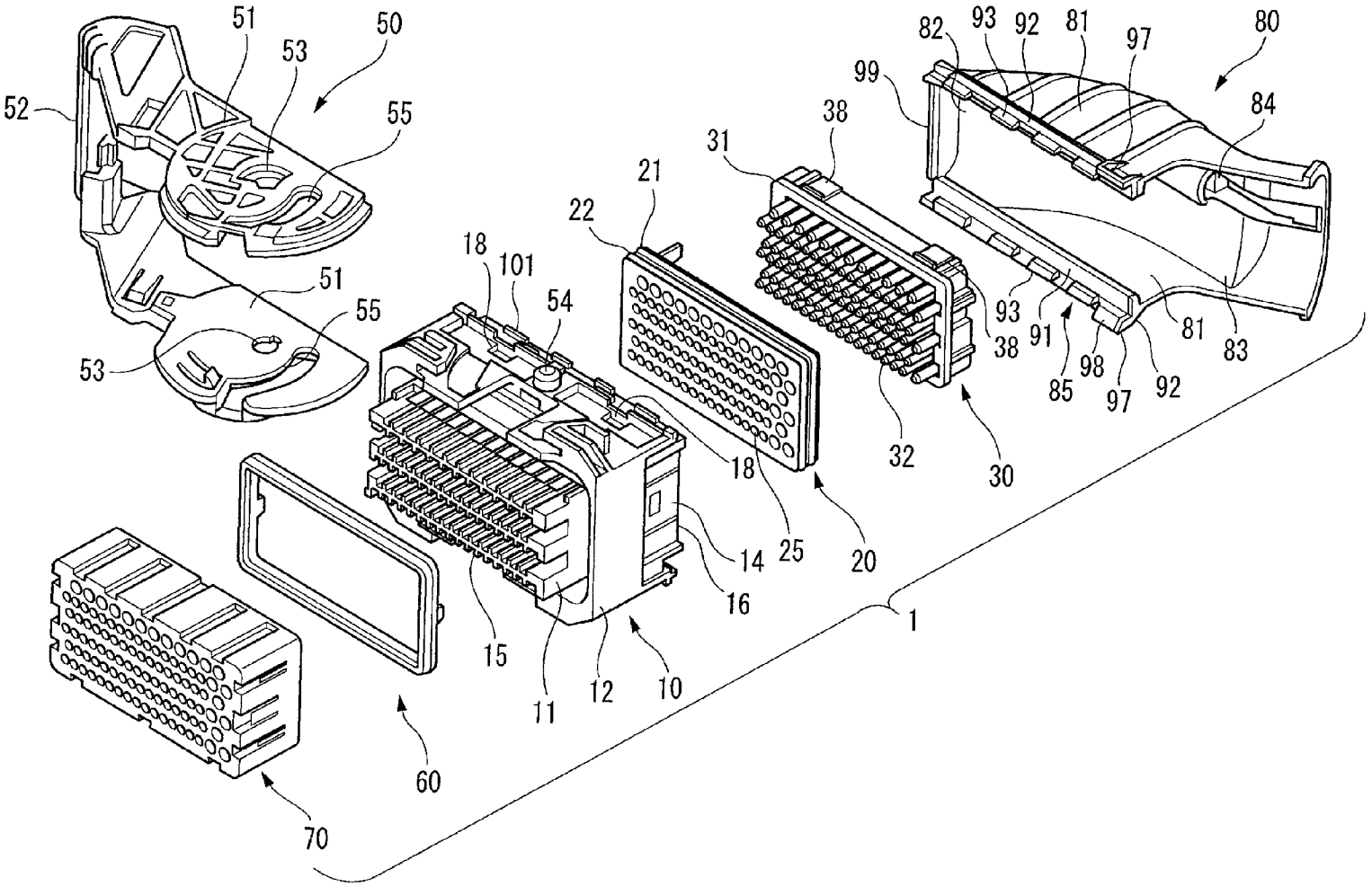
FIG. 1 is an exploded perspective view showing a connector according to an embodiment of the present disclosure.

FIG. 1 is an exploded perspective view showing a connector according to the embodiment of the present disclosure.

As shown in FIG. 1, a connector 1 according to the embodiment is equipped with a connector housing (housing) 10 which is made of synthetic resin and in which a plurality of terminals (not shown) are housed from the rear; a mat seal 20 which is made of rubber or flexible resin and is fitted in the rear part of the connector housing 10; a mat seal cover 30 which is made of synthetic resin and fitted in and secured to the rear part of the connector housing 10 to prevent the mat seal 20 from coming off while pressing the mat seal cover 30 from the rear side; a lever 50 which is made of synthetic resin and rotatably mounted on the outside of the connector housing 10; a packing 60 which is inserted into the inside of the connector housing 10 from the front; a front holder 70 which is mounted on the front portion of the connector housing 10, and an electric wire cover 80 which is mounted on the rear side of the mat seal cover 30. The connector 1 is a waterproof connector in which electric wires are sealed to the connector housing 10 using the mat seal 20 mounted on the rear part of the connector housing 10.

The connector housing 10 is equipped with an inner housing 11 which is provided on the inner circumferential side and has a plurality of terminal housing portions 15 for housing the respective terminals; an outer housing 12 which is provided on the outer circumferential side of the inner housing 11; and a tubular wall portion 14 which is disposed on the rear sides of the inner housing 11 and the outer housing 12 and into which the mat seal 20 is fitted. The outer housing 12 is a portion to be fitted on the outer circumference of the fitting tubular wall of the connector housing of a mating connector, not shown. The inner housing 11 is a portion to be fitted into the inner circumference of the fitting tubular wall of the connector housing of the mating connector.

The mat seal 20 has, on the outer circumference of a mat body 21, a lip portion 22 that seals the clearance between the mat body 21 and the tubular wall portion 14 when the mat body 21 is fitted into the inner circumference of the tubular wall portion 14 on the rear part of the connector housing 10. Terminal insertion holes 25 passing through the mat body 21 are formed at the positions in the mat body 21 corresponding to the respective terminal housing portions 15 of the connector housing 10. In a state in which the mat seal 20 is fitted into the inner circumference of the tubular wall portion 14 on the rear part of the connector housing 10, when the respective terminals are inserted into the terminal housing portion 15 through the terminal insertion holes 25, the inner circumferences of the terminal insertion holes 25 make close contact with the outer circumferences of the electric wires extending rearward from the respective terminals, whereby the respective electric wires are collectively sealed to the connector housing 10.

The mat seal cover 30 is disposed on the rear side of the mat seal 20. When the locking portions 38 of the mat seal cover 30 are engaged with the locking portions 18 of the connector housing 10, the mat seal cover 30 performs a function for applying a pressing force for preventing the mat seal 20 from coming off and for allowing the mat seal 20 to exhibit sufficient sealing performance. The cover body 31 of the mat seal cover 30, that is, a molded article made of rubber or synthetic resin, is provided with through holes 32 at the positions corresponding to the respective terminal insertion holes 25 of the mat seal 20 so that the terminals are inserted into the through holes 32 and the electric wires are led out rearward from the through holes 32.

The lever 50 has a pair of side plate portions 51 and a grip portion 52 for connecting one end sides of these side plate portions 51 to each other. Rotation holes 53 are formed in the side plate portions 51 and a rotation shaft 54 formed in the connector housing 10 is fitted in these rotation holes 53. Hence, the lever 50 is made rotatable around the rotation shaft 54. Cam grooves 55 are formed in the side plate portions 51, and cam pins provided in the connector housing of the mating connector are inserted into these cam grooves 55. In a state in which the cam pins of the mating connector are disposed in the end portions of the cam grooves 55 of the lever 50, when the grip portion 52 is gripped and the lever 50 is rotated, the cam pins are engaged with the cam grooves 55, whereby the connector housing of the mating connector is pulled to the connector housing 10 of the connector 1. Hence, the mating connector is connected to the connector 1 with a low insertion force. In this way, the connector 1 serves as a waterproof connector and also serves as an LIF (Low Insertion Force) connector to which the mating connector is connected with a low insertion force by the operation of the lever 50.

Figure 2:
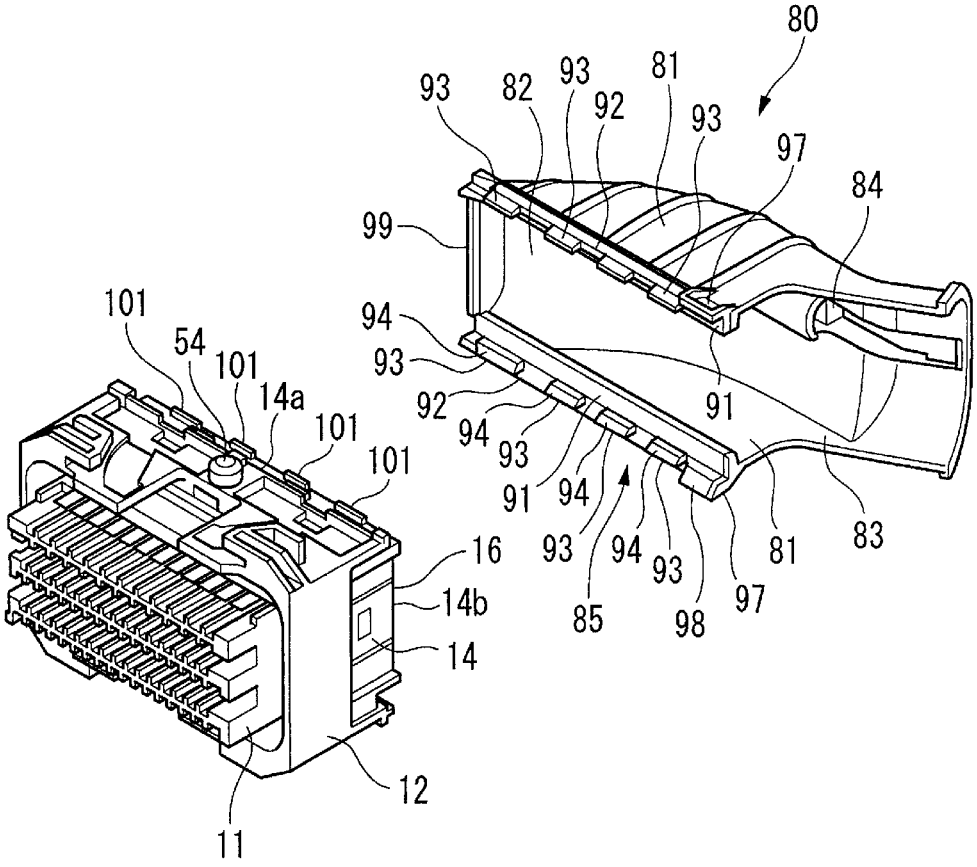
FIG. 2 is a perspective view showing the connector housing and the electric wire cover of the connector.
Figure 3A:
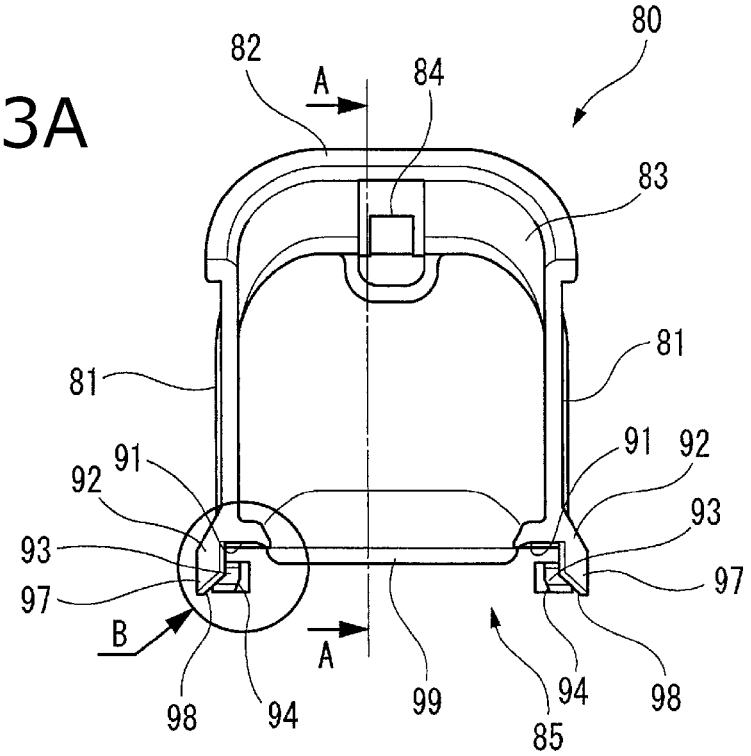
FIGS. 3A and 3B are views illustrating the electric wire cover.
Figure 3B:
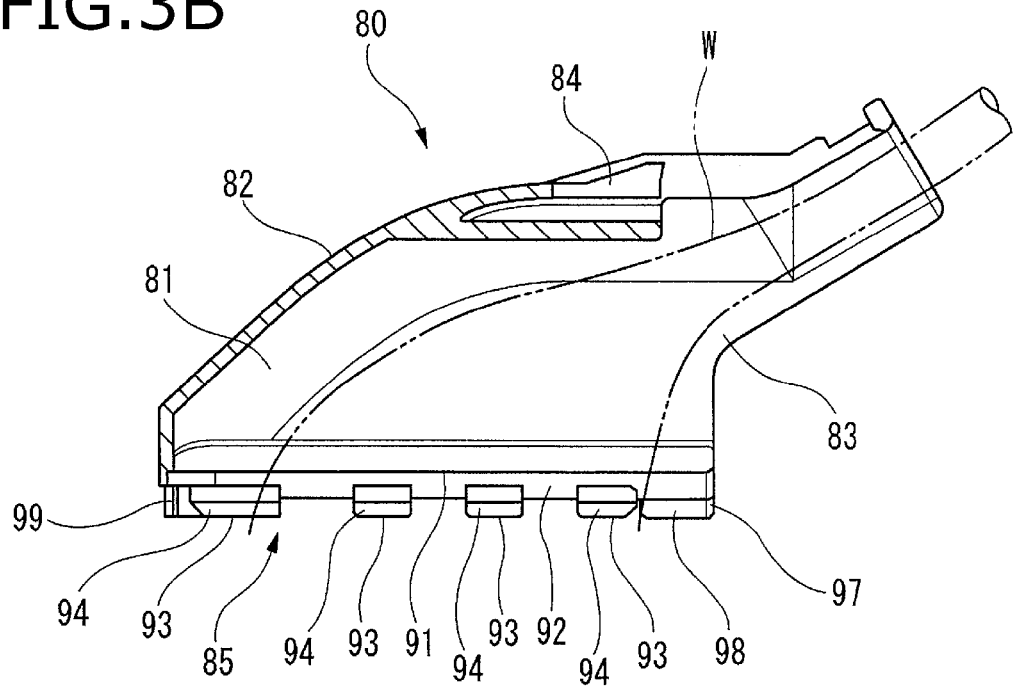
Figure 4:
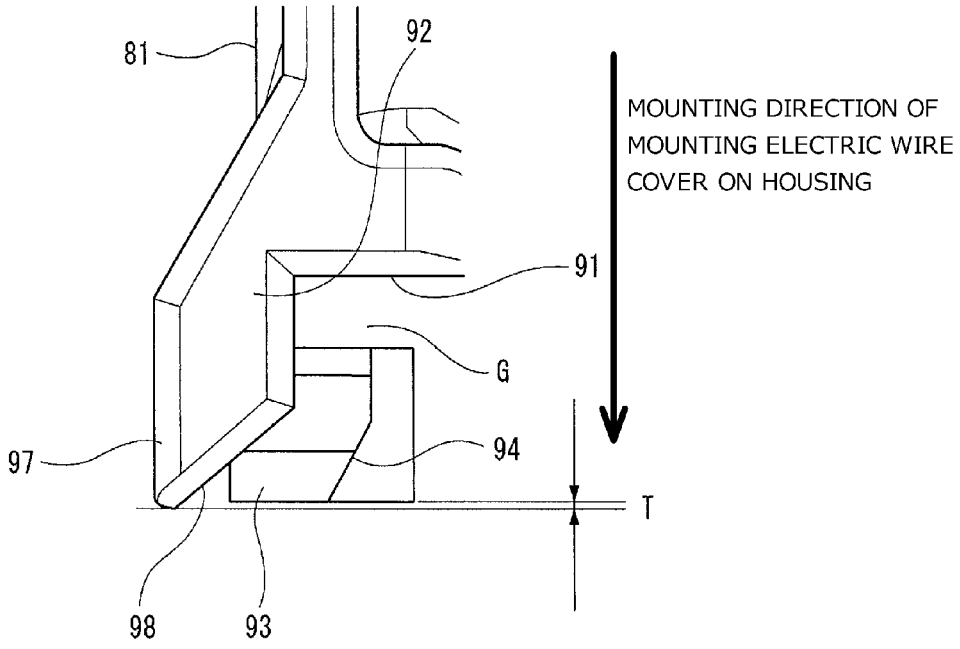
FIG. 4 is an enlarged view showing the B section in FIG. 3A.
Figure 5:
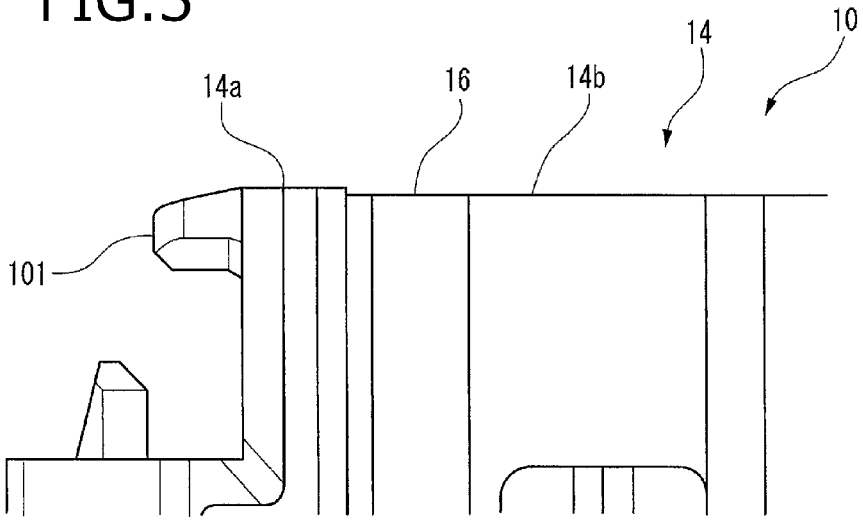
FIG. 5 is an enlarged side view showing part of the electric wire leading portion of the connector housing.

FIG. 2 is a perspective view showing the connector housing and the electric wire cover. FIGS. 3A and 3B are views illustrating the electric wire cover; FIG. 3A is a front view showing the electric wire cover as seen from the side of the electric wire guiding portion of the electric wire cover, and FIG. 3B is a sectional view taken on line A-A in FIG. 3A. FIG. 4 is an enlarged view showing the B section in FIG. 3A. FIG. 5 is an enlarged side view showing part of the electric wire leading portion of the connector housing.

As shown in FIG. 2 and FIGS. 3A and 3B, the electric wire cover 80 is an integrally molded article made of resin and has a pair of side wall portions 81 and a connecting wall portion 82 for connecting these side wall portions 81 to each other. The side wall portions 81 are disposed at positions opposed to each other, and the connecting wall portion 82 is extended from one end sides of the side wall portions 81 to the other end sides thereof so as to cover the upper sides of the side wall portions 81, and further extended beyond the other ends of the side wall portions 81. Furthermore, in the electric wire cover 80, the other end sides of the side wall portions 81 on the opposite sides of the one end sides of the side wall portions 81 are open, the side wall portions 81 being connected to each other at the one end sides by the connecting wall portion 82. This open portion is used as an electric wire guiding portion 83. Electric wires W led out from the connector housing 10 are bundled and derived from the electric wire guiding portion 83. Moreover, on the connecting wall portion 82, a lever locking portion 84 is provided at a position above the side wall portions 81.

In the electric wire cover 80, the edge portions of the side wall portions 81 and the edge portion of the connecting wall portion 82 are formed into an assembling portion 85, and this assembling portion 85 is assembled with the connector housing 10.

As shown in FIG. 4, the assembling portion 85 of the electric wire cover 80 has sliding faces 91 on the edge portion sides of the side wall portions 81 and engaging walls 92 protruding in the assembling direction from the outer edges of the sliding faces 91 to the connector housing 10. Furthermore, a plurality of locking protrusions 93 are formed inside the engaging walls 92 at intervals. A clearance G is formed between the locking protrusion 93 and the sliding face 91. A locking guide face 94 gradually inclined outward in the direction of mounting the electric wire cover 80 on the connector housing 10 is formed on the locking protrusion 93.

Moreover, a catching portion 97 is formed at the end portion of the engaging wall 92 on the side of the electric wire guiding portion 83. This catching portion 97 protrudes in the direction of mounting the electric wire cover 80 on the connector housing 10, and on the inner face side of the catching portion 97, a sliding face 98 gradually inclined outward in the direction of mounting the electric wire cover 80 on the connector housing 10 is formed. The catching portion 97 protrudes more than the locking protrusion 93 by a dimension T in the direction of mounting the electric wire cover 80 on the connector housing 10.

As shown in FIGS. 3A and 3B, at the edge portion of the connecting wall portion 82, the assembling portion 85 of the electric wire cover 80 has a contact portion 99 protruding in the direction of mounting the electric wire cover 80 on the connector housing 10.

As shown in FIG. 2, the tubular wall portion 14 of the connector housing 10 is formed into a rectangular shape having long-side portions 14*a* and short-side portions 14*b*. The edge portion of the tubular wall portion 14 is formed into an electric wire leading portion 16, and the assembling portion 85 of the electric wire cover 80 is assembled with this electric wire leading portion 16. As shown in FIG. 5, a plurality of locking ribs 101 protruding outward are formed on the sides of the long-side portions 14*a* of the electric wire leading portion 16. These locking ribs 101 are disposed at the same pitch as the locking protrusions 93 of the electric wire cover 80.

Next, a case in which the electric wire cover 80 is assembled with the electric wire leading portion 16 of the connector housing 10 will be described below.

Figure 6:
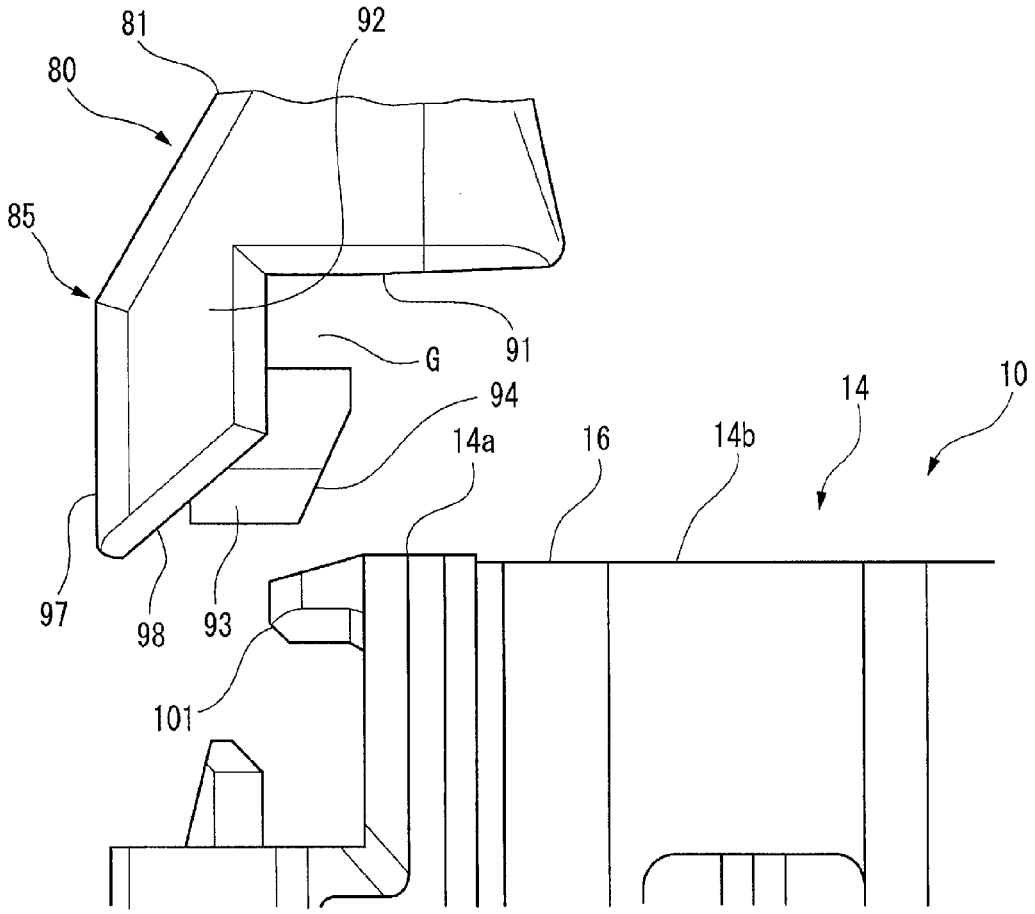
FIG. 6 is a side view illustrating the assembling of the electric wire cover with the connector housing and showing an assembling portion.
Figure 7:
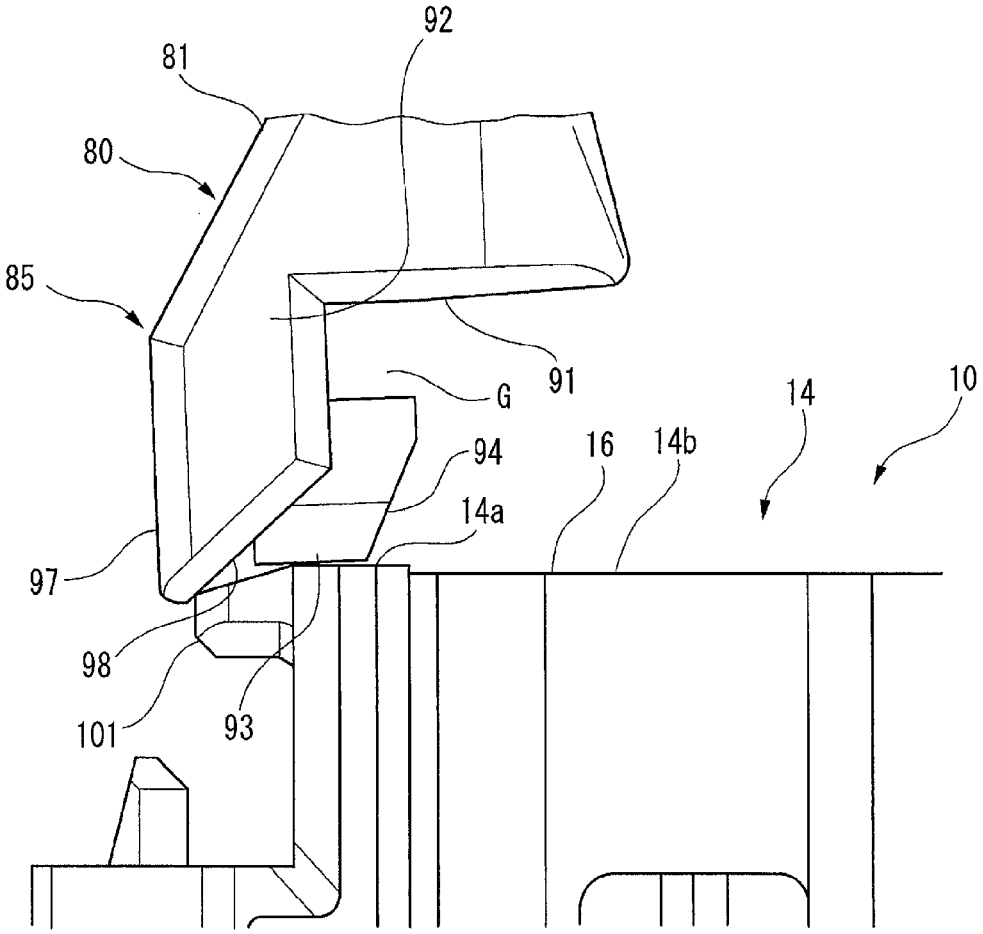
FIG. 7 is a side view illustrating the assembling of the electric wire cover with the connector housing and showing the assembling portion in the case that the electric wire cover is distorted.

FIG. 6 is a side view illustrating the assembling of the electric wire cover with the connector housing and showing an assembling portion. FIG. 7 is a side view illustrating the assembling of the electric wire cover with the connector housing and showing the assembling portion in the case that the electric wire cover is distorted.

As shown in FIG. 6, the assembling portion 85 of the electric wire cover 80 is brought close to the connector housing 10 from the rear side of the connector housing 10. At this time, the electric wire cover 80 is shifted to the opposite side of the electric wire guiding portion 83, that is, in a direction orthogonal to the mounting direction, so that the locking protrusions 93 of the assembling portion 85 do not interfere with the locking ribs 101. Furthermore, the electric wires W led out from the connector housing 10 are bundled and disposed at the electric wire guiding portion 83 of the electric wire cover 80.

When the assembling portion 85 of the electric wire cover 80 is brought close to the electric wire leading portion 16 of the connector housing 10, the locking protrusions 93 of the electric wire cover 80 pass through between the locking ribs 101 and through the sides of the locking ribs 101, thereby being disposed more on the front side than the locking ribs 101 in the mounting direction, whereby the sliding faces 91 of the electric wire cover 80 make contact with the end face of the electric wire leading portion 16 of the connector housing 10. Since the locking guide face 94 gradually inclined outward in the direction of mounting the electric wire cover 80 on the connector housing 10 is formed inside the locking protrusion 93, the locking guide face 94 makes contact with the edge portion of the electric wire leading portion 16, whereby the locking protrusion 93 is smoothly guided to the outside of the electric wire leading portion 16.

When the electric wire cover 80 is slid with respect to the connector housing 10 toward the side of the electric wire guiding portion 83 until the contact portion 99 makes contact with the short-side portion 14*b* of the tubular wall portion 14 serving as the electric wire leading portion 16, the locking rib 101 enters the clearance G between each locking protrusion 93 and the sliding face 91 of the electric wire cover 80, and each locking protrusion 93 is set to a state of being locked with the locking rib 101. Hence, the assembling portion 85 of the electric wire cover 80 is assembled with the electric wire leading portion 16 of the connector housing 10, whereby the electric wire leading portion 16 is set to a state of being covered with the electric wire cover 80.

In addition, by the assembling of the electric wire cover 80 with the connector housing 10, the electric wires W led out from the connector housing 10 are covered with and protected by the electric wire cover 80, and the bundle of the electric wires W is guided in a predetermined direction toward the side of the electric wire guiding portion 83 by the electric wire cover 80. Furthermore, when the lever 50 is rotated and the mating connector is connected to the connector 1 in which the electric wire cover 80 is mounted, the grip portion 52 of the rotated lever 50 is locked with the lever locking portion 84 of the electric wire cover 80. Consequently, the reverse rotation of the lever 50 is restricted and the connection state between the connector 1 and the mating connector is maintained securely.

As described above, the locking guide face 94 gradually inclined outward in the direction of mounting the electric wire cover 80 on the connector housing 10 is formed inside the locking protrusion 93 of the assembling portion 85 of the electric wire cover 80. Hence, when the electric wire cover 80 is assembled with the connector housing 10, the locking guide face 94 makes contact with the edge portion of the electric wire leading portion 16, whereby the locking protrusion 93 is smoothly guided toward the outside of the electric wire leading portion 16.

However, the electric wire cover 80, that is, an integrally molded article made of resin, may be distorted sometimes during molding. In particular, since the electric wire cover 80 is open at the electric wire guiding portion 83, the side wall portions 81 may be distorted so as to be inclined inward in some cases. In such cases, if the distortion of the electric wire cover 80 is small, the locking guide face 94 makes contact with the edge portion of the electric wire leading portion 16 when the electric wire cover 80 is assembled with the connector housing 10, whereby the locking protrusion 93 is smoothly guided toward the outside of the electric wire leading portion 16. However, if the distortion of the electric wire cover 80 is large, the end face of the locking protrusion 93 makes contact with the end face of the electric wire leading portion 16 when the electric wire cover 80 is assembled with the connector housing 10, whereby the electric wire cover 80 cannot be smoothly mounted on the connector housing 10 in some cases.

If the electric wire cover 80 is distorted as described above in the connector 1 according to the embodiment, when the electric wire cover 80 is assembled with the connector housing 10, the sliding face 98 of the catching portion 97 protruding more than the locking protrusion 93 in the direction of mounting the electric wire cover 80 on the connector housing 10 makes contact with and slides along the locking rib 101 serving as part of the connector housing 10 before the end face of the locking protrusion 93 makes contact with the end face of the electric wire leading portion 16 as shown in FIG. 7. As a result, a component of the force for assembling the electric wire cover 80 with the connector housing 10 is applied to the side wall portions 81 of the electric wire cover 80, and the side wall portions 81 are expanded outward by the component of the assembling force. Then, the locking guide face 94 of the locking protrusion 93 makes contact with the edge portion of the electric wire leading portion 16, whereby the locking protrusion 93 is smoothly guided toward the outside of the electric wire leading portion 16.

As described above, with the connector 1 according to the embodiment, when the electric wire cover 80 is assembled with the connector housing 10, the sliding face 98 of the catching portion 97 protruding more than the locking protrusion 93 in the direction of mounting the electric wire cover 80 on the connector housing 10 makes contact with the electric wire leading portion 16 of the connector housing 10, whereby the assembling portion 85 is displaced outward. Hence, even if the electric wire cover 80 is distorted, the difficulty of the assembling due to the bumping of the locking protrusion 93 against the connector housing 10 is prevented, whereby the electric wire cover 80 can be smoothly mounted on the connector housing 10. Consequently, the assembling workability of the electric wire cover 80 can be improved.

Furthermore, since the catching portions 97 are provided at the end portions on the side of the electric wire guiding portion 83 that is liable to be affected by the distortion particularly during the molding of the electric wire cover 80 in which the electric wire guiding portion 83 is formed, the distortion of the electric wire cover 80 can be corrected effectively by the catching portions 97 when the electric wire cover 80 is mounted on the connector housing 10.

Since the distortion of the electric wire cover 80 is corrected by the catching portions 97 in the embodiment as described above, the biting of the electric wires W can be suppressed when the electric wire cover 80 is slid and the locking protrusions 93 are locked with the locking ribs 101, whereby the electric wires W and components such as the electric wire cover 80 can be prevented from being damaged due to the biting of the electric wires W. Hence, it is possible to reduce the worker's burden of paying attention to the biting of the electric wires W at the time of the assembling of the electric wire cover 80.

When the electric wire cover 80 is assembled with the connector housing 10, it is preferable that the electric wire cover 80 should be assembled from the side of the electric wire guiding portion 83 on which the catching portions 97 are formed. In the case that this procedure is performed, the catching portions 97 make contact with the locking ribs 101, whereby the distance between the side wall portions 81 is increased and then the locking protrusions 93 are brought close to the connector housing 10. Hence, the end portions of the locking protrusions 93 can be suppressed more securely from making contact with the end face of the electric wire leading portion 16. Moreover, when the electric wire cover 80 is mounted on the connector housing 10, in the case that the electric wire cover 80 is assembled from the side of the electric wire guiding portion 83 on which the catching portions 97 are formed, the respective locking protrusions 93 can be brought close to the connector housing 10 in a state in which the bundle of the electric wires W led out from the connector housing 10 is derived from the electric wire guiding portion 83. Consequently, the electric wire cover 80 can be mounted on the connector housing 10 while the biting of the electric wires W between the sliding faces 91 and the end face of the electric wire leading portion 16 is suppressed securely.

However, the present disclosure is not limited to the above-mentioned embodiment, but can be modified or improved as necessary. In addition, the materials, shapes, dimensions, quantities, arrangement positions, etc. of the respective components in the above-mentioned embodiment may be arbitrary and not limited, provided that the present disclosure can be achieved.

The characteristics of the embodiment of the connector according to the above-mentioned present disclosure will be briefly summarized and listed in the following items [1] to [5].

[1] A connector (1) including:

a housing (10) including:

a terminal housing portion (15) configured to receive a terminal connected to an electric wire (W); and an electric wire leading portion (16) from which the electric wire (W) is led out; and an electric wire cover (80) configured to be assembled with the electric wire leading portion (16) so as to cover the electric wire (W), wherein a locking rib (101) protruding outward is formed on a circumference portion of the electric wire leading portion (16);

wherein an assembling portion (85) configured to surround the circumference portion of the electric wire leading portion (16) is formed on an end part of the electric wire cover (80) facing to the housing (10);

wherein the assembling portion (85) including:

a locking protrusion (93) protruding inward to be locked with the locking rib (101); and a catching portion (97) protruding more than the locking protrusion (93) in a mounting direction of mounting the electric wire cover (80) on the housing (10);

wherein the catching portion (97) includes a sliding face (98) gradually inclined outward with respect to the mounting direction; and wherein when the electric wire cover (80) is mounted on the housing (10), the sliding face (98) of the catching portion (97) makes contact with the electric wire leading portion (16), thereby the assembling portion (85) is displaced outward.

[2] The connector (1) configured as described in the above-mentioned item [1], wherein an electric wire guiding portion (83) is formed in the electric wire cover (80) and is configured to derive the electric wire (W), the electric wire guiding portion (83) having the end part of the electric wire cover (80); and wherein the catching portion (97) is provided at an end portion of the electric wire cover (80) on the side of the electric wire guiding portion (83).

[3] The connector (1) configured as described in the above-mentioned item [2], wherein the electric wire cover (80) is brought close to the housing (10) in a state of being displaced to the opposite side of the electric wire guiding portion (83) with respect to the housing (10), and the locking protrusion (93) being disposed more on a front side than the locking rib (101) in the mounting direction is slid toward the electric wire guiding portion (83) with respect to the housing (10), thereby the locking protrusion (93) is disposed at a position where the locking protrusion (93) is locked with the locking rib (101).

[4] The connector (1) configured as described in the above-mentioned item [1], wherein the catching portion (97) is provided at an end of the assembling portion (85) in a width direction of the electric wire cover (80) being substantially perpendicular to the mounting direction.

[5] The connector (1) configured as described in the above-mentioned item [1], wherein a protruding amount of the catching portion (97) protruding from the assembling portion (85) in the mounting direction is greater than that of the locking protrusion (93) protruding from the assembling portion (85) in the mounting direction.

What is claimed is:

1. A connector comprising:

a housing comprising:

a terminal housing portion configured to receive a terminal connected to an electric wire; and an electric wire leading portion from which the electric wire is led out; and an electric wire cover configured to be assembled with the electric wire leading portion so as to cover the electric wire, wherein a locking rib protruding outward is formed on a circumference portion of the electric wire leading portion;

wherein an assembling portion configured to surround the circumference portion of the electric wire leading portion is formed on an end part of the electric wire cover facing to the housing;

wherein the assembling portion comprises:

a locking protrusion protruding inward to be locked with the locking rib; and a catching portion protruding more than the locking protrusion in a mounting direction of mounting the electric wire cover on the housing;

wherein the catching portion comprises a sliding face gradually inclined outward with respect to the mounting direction; and wherein when the electric wire cover is mounted on the housing, the sliding face of the catching portion makes contact with the electric wire leading portion, thereby the assembling portion is displaced outward.

2. The connector according to claim 1, wherein an electric wire guiding portion is formed in the electric wire cover and is configured to derive the electric wire, the electric wire guiding portion having the end part of the electric wire cover; and wherein the catching portion is provided at an end portion of the electric wire cover on the side of the electric wire guiding portion.

3. The connector according to claim 2, wherein the electric wire cover is brought close to the housing in a state of being displaced to a opposite side of the electric wire guiding portion with respect to the housing, and the locking protrusion being disposed more on a front side than the locking rib in the mounting direction is slid toward the electric wire guiding portion with respect to the housing, thereby the locking protrusion is disposed at a position where the locking protrusion is locked with the locking rib.

4. The connector according to claim 1, wherein the catching portion is provided at an end of the assembling portion in a width direction of the electric wire cover being substantially perpendicular to the mounting direction.

5. The connector according to claim 1, wherein a protruding amount of the catching portion protruding from the assembling portion in the mounting direction is greater than that of the locking protrusion protruding from the assembling portion in the mounting direction.

* * * * *